US010414162B2

(12) United States Patent
Elgee et al.

(10) Patent No.: US 10,414,162 B2
(45) Date of Patent: Sep. 17, 2019

(54) DETECTING DROPLETS

(71) Applicant: Hewlett-Packard Development Company, L.P., Houston, TX (US)

(72) Inventors: Steven B Elgee, Portland, OR (US); Gregory N Burton, Camas, WA (US); Jody L Clayburn, Vancouver, WA (US); Lorraine T Widmann, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/763,488

(22) PCT Filed: Jan. 19, 2016

(86) PCT No.: PCT/US2016/013928

§ 371 (c)(1),
(2) Date: Mar. 27, 2018

(87) PCT Pub. No.: WO2017/127055

PCT Pub. Date: Jul. 27, 2017

(65) Prior Publication Data

US 2018/0281421 A1 Oct. 4, 2018

(51) Int. Cl.

| | |
|---|---|
| ***B41J 2/175*** | (2006.01) |
| ***B41J 2/045*** | (2006.01) |
| ***B41J 2/125*** | (2006.01) |
| ***B41J 2/165*** | (2006.01) |
| ***B41J 29/393*** | (2006.01) |
| ***B41J 29/38*** | (2006.01) |
| ***B41J 2/21*** | (2006.01) |

(52) U.S. Cl.

CPC ..... *B41J 2/175* (2013.01); *B41J 2/0458* (2013.01); *B41J 2/04561* (2013.01); *B41J 2/04581* (2013.01); *B41J 2/125* (2013.01); *B41J 2/16579* (2013.01); *B41J 2/2142* (2013.01); *B41J 29/38* (2013.01); *B41J 29/393* (2013.01)

(58) Field of Classification Search

CPC .... B41J 2/0451; B41J 2/0456; B41J 2/04561; B41J 2/0458; B41J 2/04581; B41J 2/125; B41J 2/165; B41J 2/16579; B41J 29/38; B41J 29/393; B41J 2/2142; B41J 2/175

See application file for complete search history.

(56) References Cited

U.S. PATENT DOCUMENTS

| | | | |
|---|---|---|---|
| 4,922,268 | A | 5/1990 | Osborne |
| 5,627,571 | A | 5/1997 | Anderson et al. |
| 6,918,644 | B2 | 7/2005 | Aruga |

(Continued)

FOREIGN PATENT DOCUMENTS

| | | |
|---|---|---|
| JP | 2007144900 | 6/2007 |

*Primary Examiner* — Anh T Vo

(74) *Attorney, Agent, or Firm* — Fabian VanCott

(57) ABSTRACT

A method of detecting droplets of printing fluid output from a nozzle array includes, in an example, grouping a number of nozzles into a number of individual groups of nozzles and sequentially detecting, with a printing fluid detector, printing fluid ejected from each group of nozzles using a linear position encoder to synchronize the position of the printing fluid detector wherein the printing fluid detector stops moving while detecting each group of nozzles.

20 Claims, 5 Drawing Sheets

(56) References Cited

U.S. PATENT DOCUMENTS

| | | | | |
|---|---|---|---|---|
| 7,918,528 | B2 * | 4/2011 | Govyadinov | B41J 2/125 347/19 |
| 8,201,913 | B2 * | 6/2012 | Govyadinov | B41J 29/393 347/14 |
| 8,376,506 | B2 | 2/2013 | Shepherd et al. | |
| 8,393,701 | B2 * | 3/2013 | Govyadinov | B41J 2/04561 347/10 |
| 8,939,542 | B2 | 1/2015 | Govyadinov et al. | |
| 9,016,819 | B2 | 4/2015 | Ricoh | |
| 9,134,233 | B2 | 9/2015 | Taff et al. | |
| 2010/0289846 | A1 | 11/2010 | Portela et al. | |
| 2012/0223991 | A1 | 9/2012 | Ono | |
| 2014/0098156 | A1 * | 4/2014 | Taff | B41J 2/04561 347/19 |
| 2015/0198715 | A1 | 7/2015 | Garay et al. | |

* cited by examiner

DETECTING DROPLETS

BACKGROUND

Printheads include a number of nozzles. These nozzles may fail for a number of reasons such that fluid ejected from the nozzles has been reduced or stopped. As a result, any resulting image via deposition of a printing fluid on the print media by an associated printing device may include significant defects in the resulting image or deposition. This results in an inferior product and user dissatisfaction.

BRIEF DESCRIPTION OF THE DRAWINGS

The accompanying drawings illustrate various examples of the principles described herein and are a part of the specification. The illustrated examples are given merely for illustration, and do not limit the scope of the claims.

Throughout the drawings, identical reference numbers designate similar, but not necessarily identical, elements.

DETAILED DESCRIPTION

Figure 1:
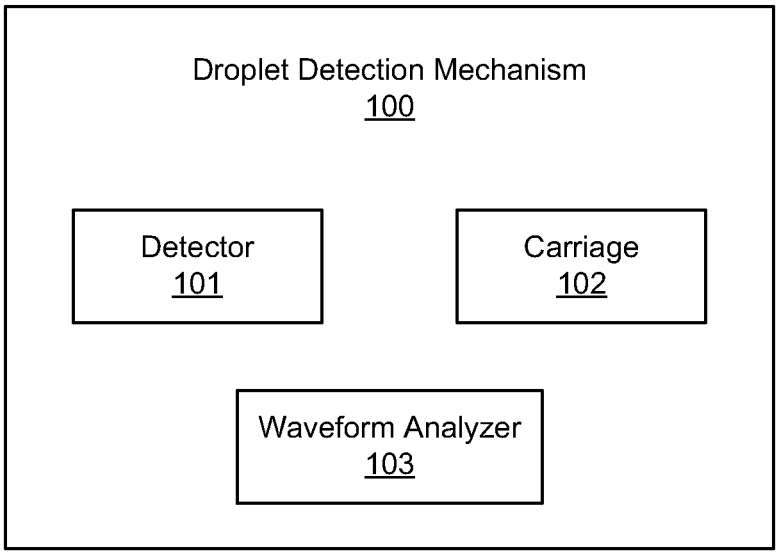
FIG. 1 is a block diagram of a droplet detection mechanism according to an example of the principles described herein.

Printhead nozzles may eject relatively small amounts of printing fluid in the form of droplets sometimes having a diameter as small as 20 microns. The relatively small size of the droplets may result in difficulties in detecting whether a proper amount of printing fluid is being ejected from any single nozzle. Consequently, it may be further difficult to determine which nozzles, if any, among the number of nozzles is not ejecting a proper or threshold amount of printing fluid.

In some examples a backscatter droplet detector (BDD) detects droplets as they are ejected out of the nozzles. The BDD works by illuminating each droplet ejected from each of the nozzles with, for example, a light source and detecting any light reflected off of the droplets. To further exasperate the difficulties in detecting printing fluid output from the nozzles, the BDD may travel relatively quickly along the nozzles at, in one example, 6.6 inches per second. This process moves the BDD across the nozzles so quickly that every $22^{nd}$ nozzle, for example, is detected thereby resulting the travel of the BDD across the nozzles 22 times: the number of nozzles detected in each pass is equal to the total number of nozzles divided by 22. Because the BDD travels so fast, an unacceptable level of noise is detected during the detection process. However, various aerosols, paper dust, and parts of the mechanisms in the printing device may also be accidentally illuminated and detected causing a false detection of reflected light. In some cases, the reflection is so illuminating that it causes the detectors to be saturated with light causing a complete whitewashing of data and poor detector results.

The present specification, describes a method of detecting droplets of printing fluid output from a nozzle array including, in one example, grouping a number of nozzles into a number of individual groups of nozzles and sequentially detecting, with a printing fluid detector, printing fluid ejected from each group of nozzles using a linear position encoder to synchronize the position of the printing fluid detector wherein the printing fluid detector stops moving while detecting each group of nozzles.

The present specification further describes a droplet detection mechanism including, in an example, at least one detector to detect a number of droplets of printing fluid ejected from a number of nozzles in a nozzle array by detecting light reflected from the number of droplets of printing fluid, a carriage coupled to a linear position encoder to detect the position of the detector along the nozzle array when droplet detection is done on the nozzles, a controller to synchronize the position of the detector while each of the number of nozzles in the nozzle array are fired, and a waveform analyzer to receive data related to the detected number of droplets each time the detector detects the number of droplets.

The present specification further describes a method of detecting droplets including sequentially detecting, with a back scatter droplet detector, printing fluid ejected from at least one of a plurality of nozzles using a linear position encoder synchronized to position the printing fluid detector center of the at least one nozzle as printing fluid is ejected from the at least one nozzle wherein the printing fluid detector is moved continuously along the plurality of nozzles.

As used in the present specification and in the appended claims, the term "printing device" is meant to be understood as any device that applies a printing fluid onto a sheet of print media or onto a print target.

Additionally, as used in the present specification and in the appended claims, the terms "media" or "print media" is meant to be understood as any surface that may receive an image thereon. In an example, a printing device may apply the image to the print media. In an example, the image may be a three-dimensional image formed by application of a number of layers of printing fluid.

Further, as used in the present specification and in the appended claims, the term "a number of" or similar language is meant to be understood broadly as any positive number comprising 1 to infinity.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an example" or similar language means that a particular feature, structure, or characteristic described in connection with that example is included as described, but may not be included in other examples.

FIG. 1 is a block diagram of a droplet detection mechanism (100) according to an example of the principles described herein. The droplet detection mechanism (100) may include a number of devices in order to achieve the functionality and methods described herein. In an example, the droplet detection mechanism (100) includes a detector (101) to detect a number of droplets ejected from a number of nozzles in a pen such as a printhead of a printing device. The droplet detection mechanism (100) further includes a carriage (102) to transport the detector (101) across a length of a nozzle array. In one example, the carriage (102) may be communicatively coupled to, in one example, a linear position encoder and a motor to move the carriage (102) across the length of the nozzle array. In an example, the carriage (102) may be communicatively coupled to a digital encoder. In an example, the carriage (102) may be communicatively coupled to an analog encoder.

The droplet detection mechanism (100) may further include a waveform analyzer (103) to receive data related to the detected number of droplets ejected from the number of nozzles in the nozzle arrays. As will be described in more detail below, the waveform analyzer (103) may receive the data in the form of waveforms captured by the detector (101) after receiving the reflected light from the printing fluid droplets. With this data, the number, size, and/or shape of printing fluid droplets may be determined and the functionality of each of the nozzles may be determined. In one example, where no printing fluid is detected to be ejected from any single nozzle, a notice may be provided to a processor, for example, indicating the dysfunctionality of the nozzle as well as the pen or printhead the nozzle belongs to.

During operation, the carriage (102) and the detector may stop in position to detect a nozzle or group of nozzles, detect whether ejection fluid is being ejected from the nozzle or group of nozzles, send the waveform data as described above, and move on to another position along the pen. Unlike a continuously moving detector, the detector (101) of the present specification sequentially detects printing fluid ejected from each of the nozzles in the pen which effectively shifts any background noise frequency spectrum that would have been detected otherwise down to frequencies as low as zero Hertz. This effectively differentiates the frequencies of light reflected off of non-droplet objects from that light reflected from the droplets. Any frequencies of light detected that have been reflected from non-droplet objects may be filtered out by the detectors before relaying the data collected onto, for example, the waveform analyzer (103) or other type of processor.

The detector (101) described herein as well as the method of using the detector (101) provides for a relatively quicker droplet detection from the nozzles than a detector (101) that travels across the entire pen at a rate of, for example, 6.66 inches per second. In the case of the relatively faster detector, the time to detect the ejection of each of the nozzles on, for example, a 9-inch print bar housing the pens may be between 5 to 12 minutes depending on whether the detector is to rescan any of the nozzles within the pen. In contrast, with the detector (101) described herein, the time taken to detect printing fluid ejected from each of the nozzles on that pen is around 2 to 3 minutes with no rescanning of any of the nozzles. This is taking into account the starting and stopping time used by the carriage to place the detector (101) in a position to detect each one or each group of droplets. Although the time frames described herein are described in terms of an example 9-inch print bar, these times may be generally scalable where the detector takes a longer time to detect the droplets on a longer bar or a shorter time where the bar is shorter than 9-inches. However, a comparison between the relatively slower detector and the present detector described herein results in the present detector finishing the detection process faster regardless of the length of the print bar.

The relatively faster detector also completes 44 scans with about 500 thousand droplets of printing fluid used during the droplet detection process. In contrast, the present detector (101) described herein completes one scan across the entire pen with all nozzles being detected and with 250 thousand droplets used during the detection process. Thus, the present detector (101) and method described herein significantly reduces wear on the any moving parts within, for example, the printing device while also reducing the fluidic volume of printing fluid used in the detection process. This, in turn reduces maintenance and supply costs for the end user and increases user satisfaction.

Figure 2:
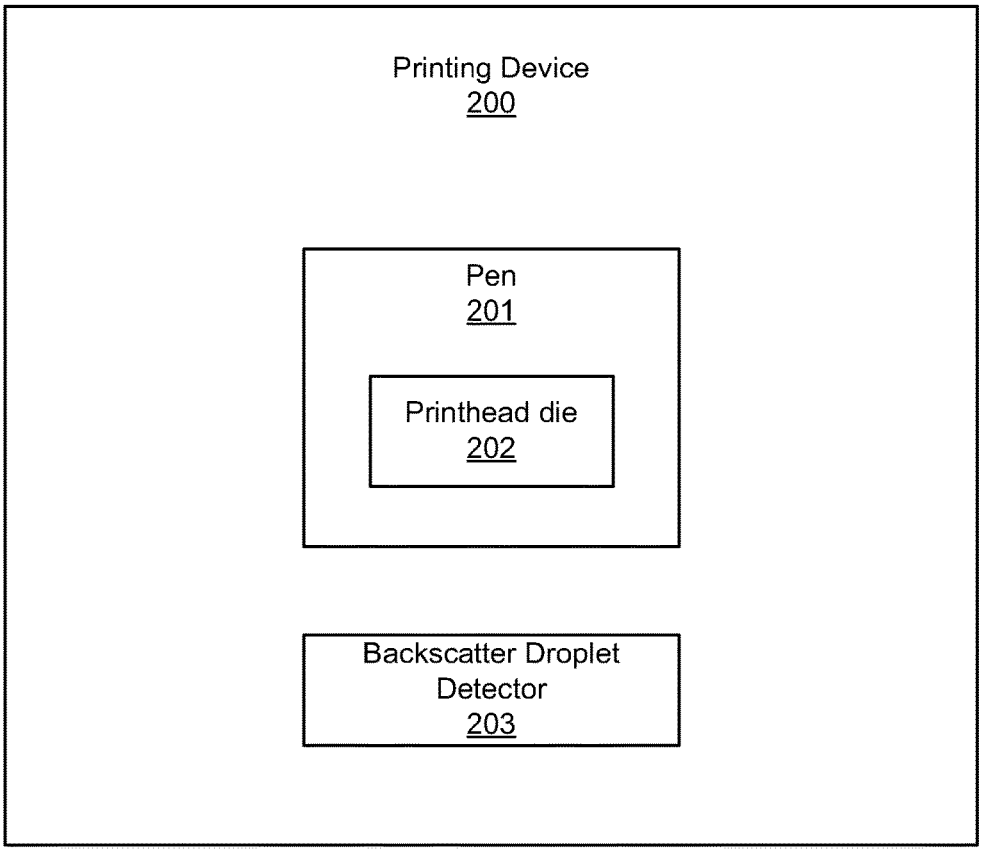
FIG. 2 is a block diagram of a printing device according to one example of the principles described herein.

FIG. 2 is a block diagram of a printing device (200) according to one example of the principles described herein. The printing device (200) may be any type of device that produces an image on a sheet of print media or produces a three-dimensional (3D) image and/or structure by depositing a printing fluid on a print target. In one example, the printing device (200) may be an inkjet printing device that ejects ink or other printing fluid out of a nozzle. The ejection of the printing fluid or other printing fluid may be accomplished through application of heat or through a piezoelectric device located behind the nozzle. In an example, the printing device (200) may be a 3D printer that ejects a heated substance onto a printing target or onto a location where the substance is to be built up. In an example, the printing device (200) may be a 3D printer that ejects a thermoconductive substance into a bed of material in, for example, successive layers of the material.

The printing device (200) may include a number of devices in order to achieve the functionality and methods described herein. In an example, the printing device (200) may include a pen (201) including a number of printhead dies (202). The pen (201) may be any device that holds or carries any number of printhead dies (202). In an example, the pen (201) may be in the form of a page-wide array including any number of printhead dies (202), each of the printhead dies (202) including any number of nozzles from which a printing fluid may be ejected out and onto a printing target or print media. In an example, the pen may be any type of device that, via a nozzle, ejects those types of printing fluid described above.

The printhead dies (202) may include any number of nozzles defined therein. In an example, the printhead dies (202) may be made of silicon and may include a number of thermoelectric devices or piezoelectric devices to eject a printing fluid out of the number of nozzles. For ease of description, the present printing device (200) is an inkjet printing device used to eject an ink or other printing fluid onto a sheet of print media. However, the present specification does contemplate the use of the presently described detector (FIG. 1, 100) and its associated components in, for example, a 3D printer or other type of printing device that deposits droplets of printing material onto a printing target.

The printing device (200) may further include a backscatter droplet detector (BDD) (203). Although the present specification describes a BDD (203), other types of detectors (FIG. 1, 100) may be used to detect the dropping of a material onto a print target. A BDD (203) such as that shown in FIG. 2 is an optical device that shines an electromagnetic wave such as visible or infrared light towards a droplet of printing fluid. The BBD (203) further includes a light detector that detects any light that is reflected from the droplet of printing fluid. The BDD (203) may then convert the detected light into a signal representing the amount of light received at the detector. This allows the printing device (200) to determine how much printing fluid, if any, is being ejected from the nozzle and the size of the droplet of printing fluid among other characteristics of the printing fluid. With this detected data from the BDD (203), it may be determined if any of the number of nozzles is defective in any way.

The BDD (203) described herein is positioned substantially perpendicular to the direction the printing fluid droplets fall such that the droplets may be detected as they pass through the electromagnetic wave produced by the BDD (203). Unlike the relatively faster detector described above, however, the BDD (203) described herein may stop in front of a number of nozzles, detect any printing fluid droplet ejected from the nozzles, and then move sequentially to other nozzles stopping each time to detect the printing fluid ejection. The locations where the BDD (203) stops may be vary depending on which nozzles are being monitored by the BDD (203). In one example, the nozzles may be organized into individual groups with each group including a number of nozzles less than the total number of nozzles. In an example, a group of nozzles may be defined by each printhead wherein the number of groups of nozzles is defined by and equal to a number of printheads into which each of the nozzles are defined.

In this example, the BDD (203) may stop in front of a first group of nozzles and detect printing fluid droplet ejected out of the nozzles in that first group before moving on to detect printing fluid ejection from a second group of nozzles. In an example, however, the BDD (203) remains stationary while detecting the printing fluid droplet before moving onto another group of nozzles or other nozzles. In another example, the BDD (203) moves continuously at a relatively slow speed (e.g., 0.30 inches/second) such that the BDD (203) is positioned center of the group of nozzles as the droplets are to be detected. This allows the BDD (203) to continuously move along the pen (201) without stopping between groups before firing of the nozzles.

In another example, the BDD (203) may detect the ejection of droplet of printing fluid out of all nozzles defined in each individual printhead die (202) of the pen (201). In this example, the BDD (203) stops in front of each printhead die (202) and their associated nozzles, again stopping each time to conduct the detection process.

In an example, the firing of each of the nozzles being detected by the BDD (203) may be time-triggered such that the BDD (203) is placed and stopped in front of any firing nozzle before firing. In this example, a motor coupled to a linear position encoder, such as an analog or high resolution digital encoder, may drive a carriage to which the BDD (203) is coupled such that the BDD (203) is placed and stopped in front of the firing nozzle or nozzles before firing occurs. The linear position encoder may, therefore, be synchronized with the time-trigger and cause the motor to move the carriage to a specific location at a specific time to avoid any lag time between detections of printing fluid droplet by the BDD (203).

As described above, the placement and stopping of the BDD (203) in front of a number of nozzles before the nozzles are fired reduces the amount of noise picked up by the BDD (203) during the detection process. The frequency of any light reflected off of non-droplet objects is effectively shifted down and rejected by a high-pass filter within the BDD (203).

Figure 3:
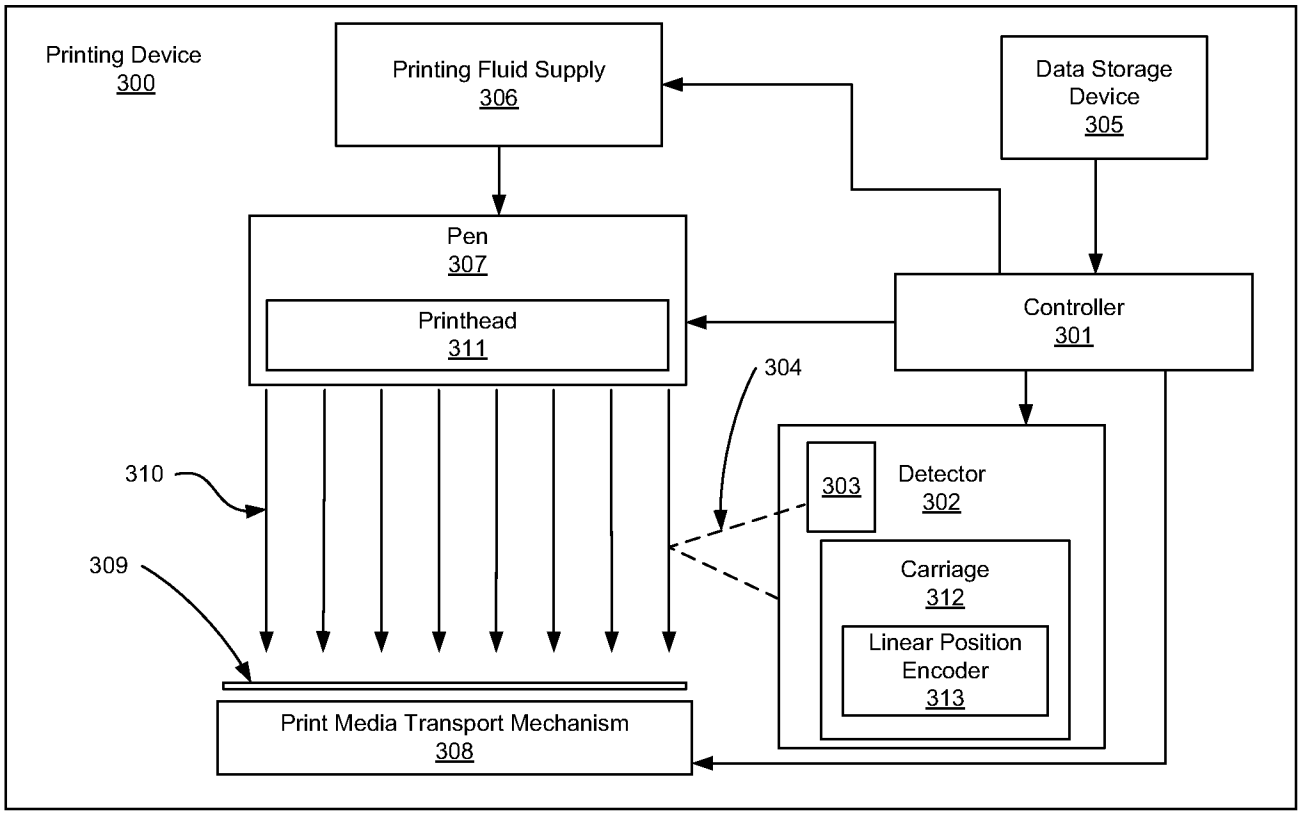
FIG. 3 is a block diagram of a printing device (300) according to an example of the principles described herein.

FIG. 3 is a block diagram of a printing device (300) according to an example of the principles described herein. The printing device (300) shown in FIG. 3 may include a printing fluid supply (306), a pen (307) including a number of printheads (311), and a print media transport mechanism (308) that work together under the control of a controller (301) to apply an amount of printing fluid onto a sheet of print media (309) to, in one example, apply an image to the sheet of print media (309). The printing fluid supply (306) may provide an amount of printing fluid to the number of printheads (311) of the pen (307). The print media transport mechanism (308) may advance a sheet of print media (309) through the printing device (300) and under the number of printheads (311) in order to receive a number of droplet (310) of printing fluid ejected from a number of nozzles defined in the number of printheads (311).

The printing device (300) may further include a data storage device (305). The data storage device (305) may store data such as executable program code that is executed by the controller (301) or other processing device. As will be discussed, the data storage device (305) may specifically store computer code representing a number of applications that the controller (301) executes to implement at least the functionality described herein.

The data storage device (305) may include various types of memory modules, including volatile and nonvolatile memory. For example, the data storage device (305) of the present example may include Random Access Memory (RAM), Read Only Memory (ROM), and Hard Disk Drive (HDD) memory. Many other types of memory may also be utilized, and the present specification contemplates the use of many varying type(s) of memory in the data storage device (305) as may suit a particular application of the principles described herein. In certain examples, different types of memory in the data storage device (305) may be used for different data storage needs. For example, in certain examples the controller (301) may boot executable code from Read Only Memory (ROM), maintain nonvolatile storage in the Hard Disk Drive (HDD) memory, and execute program code stored in Random Access Memory (RAM).

Generally, the data storage device (305) may comprise a computer readable medium, a computer readable storage medium, or a non-transitory computer readable medium, among others. For example, the data storage device (305) may be, but not limited to, an electronic, magnetic, optical, electromagnetic, infrared, or semiconductor system, apparatus, or device, or any suitable combination of the foregoing. More specific examples of the computer readable storage medium may include, for example, the following: an electrical connection having a number of wires, a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store computer usable program code for use by or in connection with an instruction execution system, apparatus, or device. In another example, a computer readable storage medium may be any non-transitory medium that contains, or stores a program for use by or in connection with an instruction execution system, apparatus, or device.

The printing device (300) may further include a detector (302). As described above, the detector (302) may emit an electromagnetic wave (304) into the path of the droplet (310) being ejected out of the number of nozzles defined in the number of printheads (311). Any electromagnetic source suitable for illuminating printing fluid droplets may be used including, for example, EELs (edge emitting lasers), VCSELs (vertical cavity surface emitting lasers) and LEDs (light emitting diodes). The electromagnetic wave (304) is then reflected off of these droplet (310) such that the electromagnetic wave (304) is received by a light sensor (303) associated with the detector (302). The light sensor (303) may be any type of sensor that can detect light such as a photodiode. In an example, the light sensor (303) may be capable of receiving and detecting a broad spectrum of reflected light. In an example, the light sensor (303) may be capable of detecting reflected light specific to the type emitted by the detector (302).

As described above, the detector (302) is coupled to a carriage (312) that translates the detector (302) across the entire pen (307). An analog or digital encoder (313) may be coupled to the carriage (312) to cause a motor to adjust the position of the detector (302) when analyzing certain printing fluid droplets (310) ejected from certain nozzles in the number of printheads (311). The controller (301) may synchronize the ejection of printing fluid droplets (310) with the linear position encoder (313) such that the detector (302) coupled to the carriage (312) is, in an example, placed and stopped in a location where the detector (302) can detect the droplets (310). In an example, the ejection of the droplets (310) from any single or group of nozzles in the number of printheads (311) is coordinated with the passing of the detector (302) in front of these nozzles or groups of nozzles. In this example, the detector (302) and carriage (312) are translated across the pen (307) at a rate of 0.3 inches per second.

In the example where the detector (302) and carriage (312) are made to stop in front of each nozzle or group of nozzles before moving on to other nozzles, the carriage (312) and detector (302) may be translated across the pen (307) at an overall rate of between 0.10 inches per second to 1.5 inches per second. In an example where the detector (302) and carriage (312) are not made to stop in front of each nozzle or group of nozzles before moving on to other nozzles, the carriage (312) and detector (302) are translated across the pen (307) at an overall rate of 0.3 inches per second.

In an example, a single pass across the pen (307) is made by the detector (302) and carriage (312). This is because all nozzle firings are detected by the detector (302) in a single pass rather than quickly running multiple passes over the pen (307) and detecting the ejection of the number of droplet (310) originating from predetermined nozzles.

In one example, the data associated with the detection of the number of droplet (310) ejected from the number of nozzles may include additional data identifying the nozzle from which each droplet (310) was ejected from. In this example, the position of the carriage (312) due to the linear position encoder (313) may help in determining which nozzle or group of nozzles are being detected and what, for example, the identification number is associated with that nozzle. This identification data may be sent to the controller (301) along with other data that describes the status of the number of droplet (310) ejected. Consequently, the controller (301) may adjust printing parameters or signal a user that a nozzle is defective based on that received data.

Figure 4:
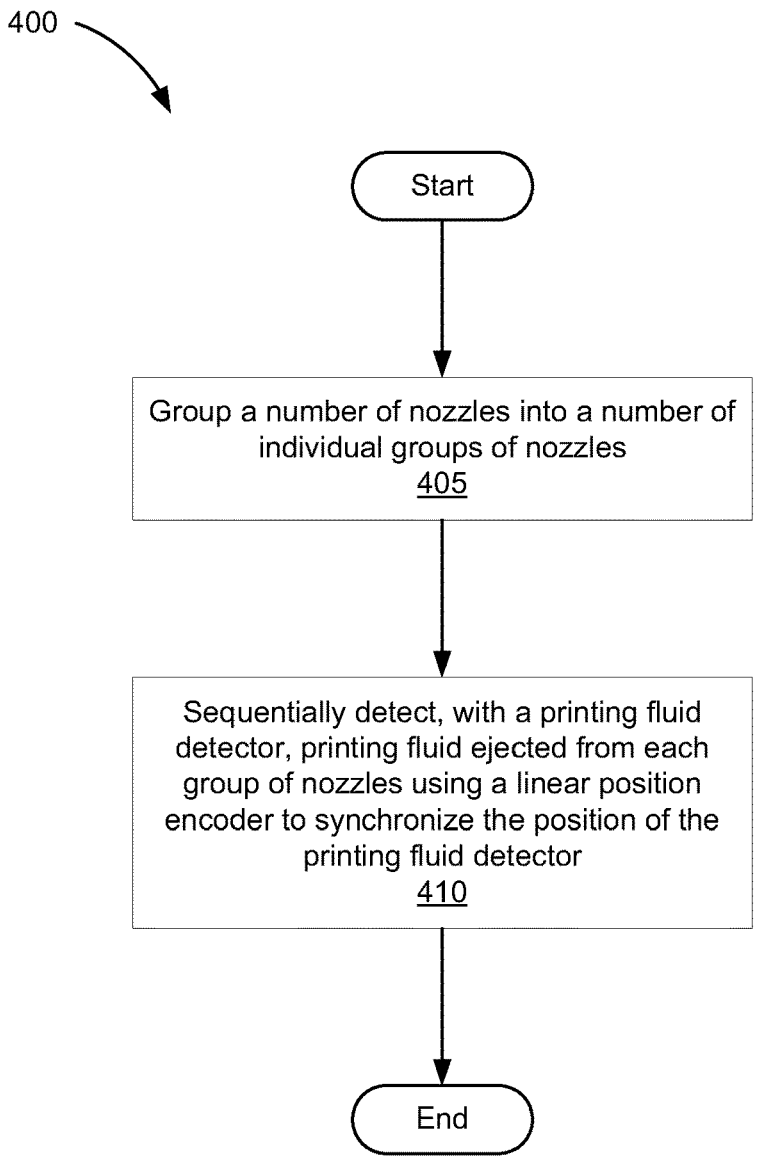
FIG. 4 is a flowchart showing a method of detecting droplets of printing fluid output from a nozzle array according to one example of the principles described herein.

FIG. 4 is a flowchart showing a method (400) of detecting droplets of printing fluid output from a nozzle array according to one example of the principles described herein. The method (400) may begin with grouping (405) a number of nozzles into a number of individual groups of nozzles. In an example, the number of nozzles in any given group may be one. In an example, the number of nozzles in any given group may be more than one. In an example, the number of nozzles in any given group may be equal among the number of groups. In an example, the number of nozzles in any given group may be uneven. In an example, the number of nozzles grouped into a given group may equal the number of nozzles defined in each of the printheads (FIG. 3, 311); all of the nozzles defined in each of the individual printheads (FIG. 3, 311) each comprising a group of nozzles.

The method (400) may continue with sequentially detecting (410), with a printing fluid detector, printing fluid ejected from each group of nozzles using a linear position encoder to synchronize the position of the printing fluid detector. As described above, the detector (FIG. 3, 302) may move into a position to detect a droplet of printing fluid ejected by a group of nozzles and stop to conduct the detection process. The positioning of the detector (FIG. 3, 302) is achieved by coordinating the firings of the nozzles within each group with a linear position encoder (313) to place the detector (FIG. 3, 302) in position to detect the droplets before firing. In an example, the controller (FIG. 3, 301) specifies precisely which nozzle is being fired at any given time. The detected waveform may be tagged with any positional information of the fired nozzle. In this example, there is no dependence upon the linear encoder for nozzle identification and instead the controller (FIG. 3, 301).

After the droplets ejected from one group of nozzles is detected by the detector (FIG. 3, 302), the detector is moved into position to detect droplets ejected from another group. This process continues sequentially until droplets ejected from all nozzles within all groups of nozzles has been detected. In an example, after printing fluid droplets from each group of nozzles has been detected by the detector (FIG. 3, 302), data describing the number, size, and/or shape of printing fluid droplets is sent to a controller (FIG. 3, 301). Because the linear position encoder (FIG. 3, 313) is aware of the positioning of the detector (FIG. 3, 302), data describing the identification of each nozzle may also be sent with the data. This allows the controller (FIG. 3, 301) to determine which of the nozzles, if any, are defective based on the failures to eject fluid or differences in the size and/or shape of any individual droplet.

Figure 5:
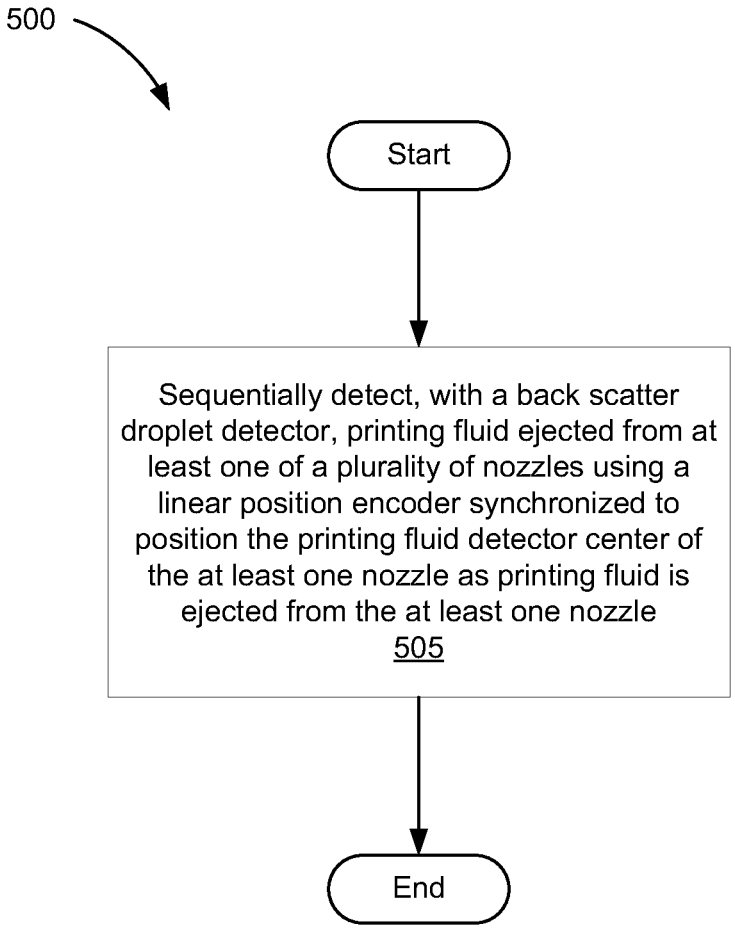
FIG. 5 is a flowchart showing a method of detecting droplets according to one example of the principles described herein.

FIG. 5 is a flowchart showing a method (500) of detecting droplets (FIG. 3, 310) according to one example of the principles described herein. The method (500) may begin with sequentially detecting (505), with a back scatter droplet detector (FIG. 3, 302), printing fluid ejected from at least one of a plurality of nozzles using a linear position encoder (FIG. 3, 313) synchronized to position the printing fluid detector (FIG. 3, 302) center of the at least one nozzle as printing fluid is ejected from the at least one nozzle. In an example, the back scatter droplet detector (FIG. 3, 302) may move continuously and sequentially from one nozzle or groups of nozzles without stopping to conduct the scan using the back scatter droplet detector (FIG. 3, 302). In this example, the back scatter droplet detector (FIG. 3, 302) moves continuously at a relatively slow speed (e.g., 0.30 inches/second). Additionally, a controller, (FIG. 3, 301) may synchronize the firing of the individual nozzles as each of the individual nozzles are fired with the position of the back scatter droplet detector (FIG. 3, 302) such that the back scatter droplet detector (FIG. 3, 302) is positioned center of where the droplet of printing fluid is to be ejected from each the nozzles.

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to the controller (FIG. 3, 301), a processor of a general purpose computer, special purpose computer, or other programmable data processing apparatus to produce a machine, such that the computer usable program code, when executed via, for example, the controller (FIG. 3, 301) or other programmable data processing apparatus, implement the functions or acts specified in the flowchart and/or block diagram block or blocks. In one example, the computer usable program code may be embodied within a computer readable storage medium; the computer readable storage medium being part of the computer program product. In one example, the computer readable storage medium is a non-transitory computer readable medium.

The specification and figures describes a method of detecting printing fluid output in a nozzle array and a droplet detection system. The present system and method provides for a relatively less noisy detected waveform detected by a detector such as a BDD. Along with less noise in the detected waveform, the process of detecting whether each of the nozzles defined in a number of printheads is conducted relatively quicker than a BDD that scans the nozzles at, for example, 6.6 inches per second. The detector described herein scans the nozzles while stopped and moves along the pen including the number of printheads at a combined speed of, for example, 0.3 inches per second. Instead of passing along the pen a number of times, the present detector passes along the entire pen once. This results in less wear on the parts of the detector and/or a printing device associated with the detector. Further, during the detection process conducted by the detector described herein, relatively less printing fluid is ejected out of the number of nozzles further reducing costs to an end consumer in costs. As a result, the detector may be more reliable in detecting droplets ejected while performing a printing fluid output method relatively quicker.

The preceding description has been presented to illustrate and describe examples of the principles described. This description is not intended to be exhaustive or to limit these principles to any precise form disclosed. Many modifications and variations are possible in light of the above teaching.

What is claimed is:

1. A method of detecting droplets of printing fluid output from a nozzle array comprising:

grouping a number of nozzles into a number of individual groups of nozzles;

sequentially detecting, with a printing fluid detector, printing fluid ejected from each group of nozzles using a linear position encoder to synchronize the position of the printing fluid detector, wherein the printing fluid detector stops moving while detecting each group of nozzles; and rejecting with a high-pass filter of the printing fluid detector, signals from light reflected by a non-droplet object.

2. The method of claim 1, wherein the number of groups nozzles is defined by and equal to a number of printheads into which each of the nozzles are defined.

3. The method of claim 2, further comprising centering the printing fluid detector on each of the number of printheads prior to detecting the printing fluid ejected from each group of nozzles.

4. The method of claim 1, further comprising sending an embedded nozzle identification associated with each of the number of nozzles.

5. The method of claim 4, further comprising detecting the size and shape of the printing fluid ejected from each of the nozzles and sending that information to a controller to determine which nozzle is dysfunctional.

6. The method of claim 5, further comprising sending the embedded nozzle identification associated with each of the number of nozzles along with the information associated with the size and shape of the printing fluid ejected from each of the nozzles after detecting each one of the individual group of nozzles.

7. The method of claim 1, wherein the printing fluid detector passes along the nozzle array once to detect droplets from each nozzle.

8. The method of claim 1, further comprising performing waveform analysis filtered signals output from the printing fluid detector to determine functionality of individual nozzles.

9. The method of claim 1, wherein the printing fluid detector is moved along the groups of nozzles at an overall rate between 0.1 and 1.5 inches per second.

10. A droplet detection mechanism comprising:

at least one detector to detect a number of droplets of printing fluid ejected from a number of nozzles in a nozzle array by detecting light reflected from the number of droplets of printing fluid;

a carriage coupled to a linear position encoder to detect the position of the detector along the nozzle array when droplet detection is done on the nozzles;

a controller to synchronize the position of the detector while each of the number of nozzles in the nozzle array are fired; and a waveform analyzer to receive data related to the detected number of droplets each time the detector detects the number of droplets.

11. The droplet detection mechanism of claim 10, further comprising a motor to drive the carriage according to instructions received from the controller.

12. The droplet detection mechanism of claim 10, wherein the data related to the detected number of droplets comprises the number of droplets, the size of the droplets, the shape of the droplets, or combinations thereof.

13. The droplet detection mechanism of claim 10, wherein the data related to the detected number of droplets comprises an identification of each of the nozzles within the nozzle array.

14. The droplet detection mechanism of claim 13, wherein the identification of each of the nozzles within the nozzle array is determined via the linear position encoder based on the position of the carriage.

15. The droplet detection mechanism of claim 10, further comprising wherein the linear position encoder is to include an embedded nozzle identification associated with data related to a detected droplet from a corresponding nozzle.

16. The droplet detection mechanism of claim 10, further comprising a high-pass filter to filter a signal from the at least one detector caused by light reflected by a non-droplet object.

17. A method of detecting droplets, comprising:

sequentially detecting, with a back scatter droplet detector, printing fluid ejected from at least one of a plurality of nozzles using a linear position encoder synchronized to position the droplet detector at a center of the at least one nozzle as printing fluid is ejected from the at least one nozzle;

wherein the droplet detector is moved continuously along the plurality of nozzles;

filtering signals produced by the droplet detector based on frequency of light detected so as to reduce noise in a detection signal output by the droplet detector; and conducting waveform analysis on the detection signal output by the droplet detector to determine health of the at least one nozzle.

18. The method of claim 17, wherein the back scatter droplet detector sequentially detects droplets ejected from a plurality of nozzles grouped together as the back scatter droplet detector passes along a pen comprising the plurality of nozzles.

19. The method of claim 17, wherein the back scatter droplet detector makes a single pass along the plurality of nozzles to detect a number of printing fluid droplets.

20. The method of claim 17, wherein the droplet detector moves at 0.3 inches per second along a pen comprising a plurality of nozzles including the at least one nozzle.

* * * * *